US007032586B1

(12) United States Patent
Lindsay

(10) Patent No.: US 7,032,586 B1
(45) Date of Patent: Apr. 25, 2006

(54) SINGLE POINT ENGRAVING CUTTER TIP

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 0 days.

(21) Appl. No.: 11/056,892

(22) Filed: Feb. 8, 2005

Related U.S. Application Data

(62) Division of application No. 10/245,677, filed on Sep. 17, 2002, now abandoned.

(51) Int. Cl.
*B28D 5/00* (2006.01)

(52) U.S. Cl. ..... 125/30.01; 30/164.9

(58) Field of Classification Search ..... 30/366, 30/168, 167, 164.9; D18/57; 33/168.1; 125/30.01
See application file for complete search history.

(56) References Cited

U.S. PATENT DOCUMENTS

| | | | | | |
|---|---|---|---|---|---|
| 2,367,841 | A | * | 1/1945 | Monroe | 407/54 |
| 2,465,305 | A | * | 3/1949 | Cope | 30/92.5 |
| 3,097,429 | A | * | 7/1963 | Frye et al. | 30/168 |
| 3,636,955 | A | * | 1/1972 | Kurtz | 606/223 |
| 4,128,351 | A | * | 12/1978 | Kurtz et al. | 606/223 |
| 4,417,423 | A | * | 11/1983 | Cave et al. | 451/41 |
| 4,473,946 | A | * | 10/1984 | Hill | 30/140 |
| 4,875,289 | A | * | 10/1989 | Poling | 30/167 |
| 4,976,033 | A | * | 12/1990 | Chia et al. | 30/366 |

OTHER PUBLICATIONS

F. H. Rees; The Art of Engraving, The Keystone Press, USA, 1909, pp. 24-29.*
Paul N. Hasluck; Engraving Metals, Lindsay Publications, Inc., USA, 2001, pp. 29-40.*
Unknown,;Firearms Engravers Guiild of America How-To Handbook Second Edition, Instructions for use of GRS Carbide Square Gravers, Firearms Engravers Guild of America, USA, 1997, pp. 33-34.*
Don Glaser; Firearms Engravers Guild of America How-To Handbook Second Edition, Testing Hendrick's Tool Geometry, Firearms Engravers Guild of America, USA, 1997, pp. 34-35.*
Don Glaser; Firearms Engravers Guild of America How-To Handbook Second Edition, Testing Hendrick's Tool Geometry, Firearms Engravers Guild of America, USA, 1997, pp. 35-36.*
R. Allen Hardy; The Jewelry Engravers Manual, Van Nostrand Reinhold Company, USA, 1976, Chapter 1, pp. 1-9.*
A. Brittain, S. Wolpert, P. Morton; Engraving on Precious metals, N.A.G. Press, Ltd., 1958, London, England, pp. 10-20.*

(Continued)

*Primary Examiner*—Charles Goodman

(57) ABSTRACT

An improved single point engraving burin tip, for use in hand engraving and stone setting in the hand engraving and jewelry fields. More specifically, the invention provides a single point engraving tip with a secondary relieving area to the primary cutting edge.

12 Claims, 9 Drawing Sheets

OTHER PUBLICATIONS

James B. Meek; The Art of Engraving, F. Brownell & Son, USA, 1973, pp. 29-37.*
Tim McCreight; The Complete Metal Smith (Revised Edition), Davis Publications, Inc., USA, 2991, pp. 24-25.*
Unknown; Heiner Tamme Engraver, Video Productions, USA, 1942, p./plate 12.*
Kenneth Steel, R. B. A., S. G. A.; The Student's Art Book, Line Engraving, Sir Isaac Pitman & Sons, Ltd., London, England, date unknown, Chapter 2, pp. 8-13.*
Albert A. Winter; A Practical Course in Jewlry Engraving, Hammel, Riglander & Co., Inc., 1939, pp. 44-47.*

* cited by examiner

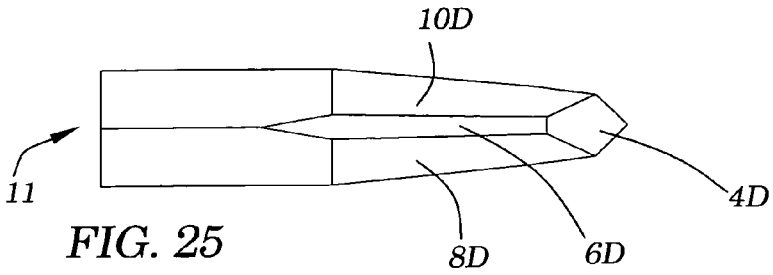
FIG. 25
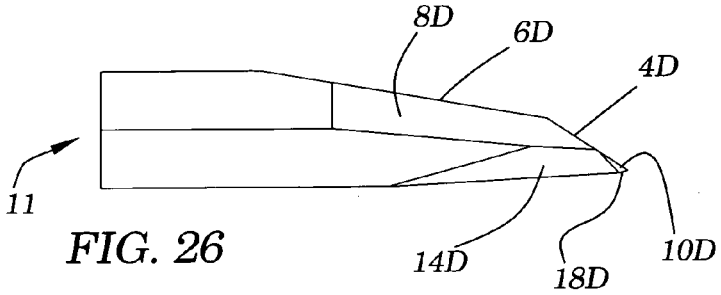
FIG. 26
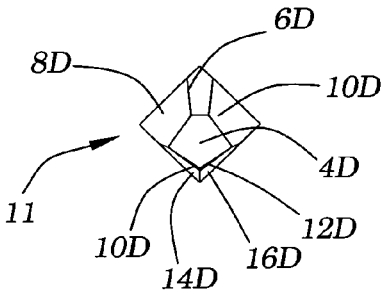
FIG. 28
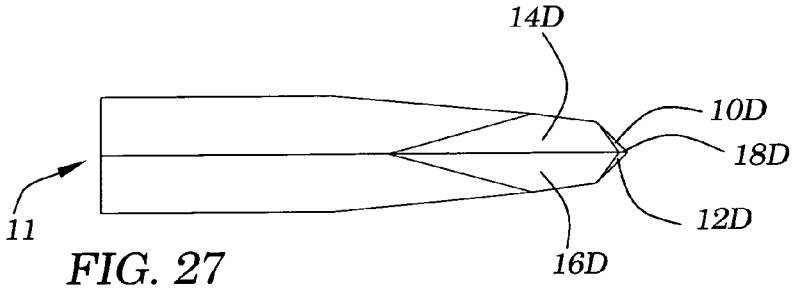
FIG. 27
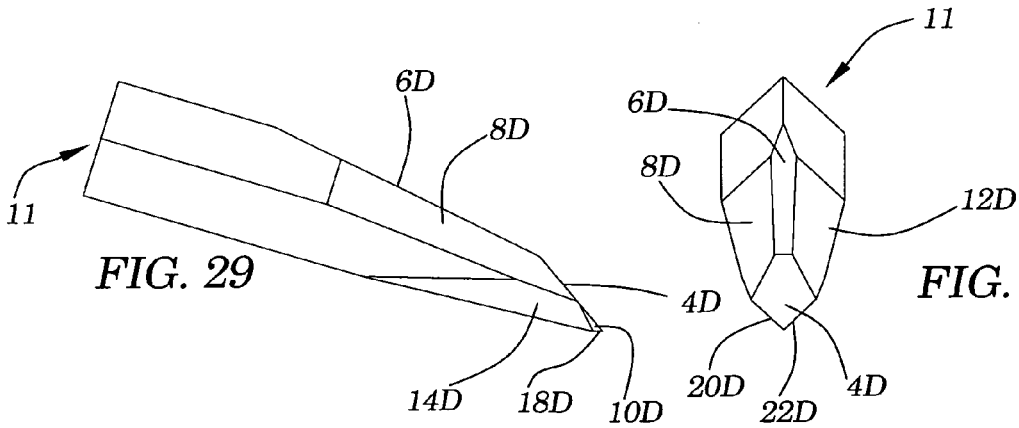
FIG. 29
FIG. 30

SINGLE POINT ENGRAVING CUTTER TIP

This application is a divisional application of prior application Ser. No. 10/245,677 filed on Sep. 17, 2002 now abandoned.

BACKGROUND OF THE INVENTION

1. Field of Invention

The invention relates to a single point engraving tip, more particularly, to an improved single point engraving tip for use in delicate hand engraving and stone setting in the hand engraving and jewelry fields.

2. Description of Prior Art

The traditional hand engraving tool which has been in existence for centuries, consists of a tool bit (also known as a tool tip or graver point or burin tip) inset into a small round handle that is made to fit into the palm of the human hand. The tool or burin tip is pushed through the material being cut. If the engraver desires to engrave deeper, the tool tip is used with a small hammer for hammering the tool cutter tip through the metal. This is known as the hammer and chisel method. In recent times, engravers have begun to use power palm push gravers for engraving such as the one disclosed in U.S. Pat. No. 6,095,256, to Lindsay. This power tool has the benefit of power plus the comfort of the traditional palm push graver. Numerous books and publications, some even before the turn of century disclose methods to shape the point of a V shaped tool tip. The prior art methods rely on a single heel angle at the under side and either side of the V at the tip. A problem that arises from this type of point is that in order to receive sufficient heel running up the side of the V on the underside, the trailing heel length becomes very long. This type of heel is helpful in providing the heel up the V sides at the cutting edges for deep engraving but it has the adverse effect of having a very long trailing heel. When a person engraves with this type of cutter in a straight line, the long heel is not a problem as it will trail behind in a straight furrow created by the cutting edges. However, when the engraver wants to cut a curve or turn a corner, the trailing end of the back of the long heel will drag on the outer side of the V furrow. The result is an unclean cut with a burr pushed up on the outer side of the curve. Engravers have compensated for this by simply placing a smaller heel on the tool tip so that the trailing heel is smaller which helps for the fine, shallow engraving but this same point does not have the benefit of having the heel running all the way up the sides of the V right at the tip for deep engraving use. The benefit of the heel running all the way up the sides of the V right at the cutting edge is that the engraver may engrave much deeper without the tool diving. Some prior art publications that teach how to sharpen a graver tip went as far as to make a special graver for turning right and another for turning left and a third for a straight cut.

Article tilted "Testing Hendick's Tool Geometry", author: Don Glaser published in: How-To Handbook, Published by Firearms Engravers Guild of America, 1997, discloses a tool tip using a square shank tool blank with a widened 110, 120 and 130 degree V with a very small heel. The heel described in this article is similar to other prior art described above. The tip illustrated in the article has a very small triangle at the extreme tip. It is labeled "heel" in the illustration on page 35 in the article. This wide V tip graver as illustrated is also illustrated and described with a secondary, very small face (less than 0.1 nm) on the front of the tool for blunting the point off that will provide a stronger point as described in the article. However, the heel disadvantages are still present in this prior art embodiment. It places a very small, triangular heel on the tip that will work nicely for finer engraving, however in order for this tool tip to be used for deeper cuts, a larger heel must be added and like other prior art in this configuration, an enlarged heel will be a large triangular heel with the undesirable long trailing heel. A tool tip with a larger triangle heel could then be used for deeper engraving cuts but the long trailing heel would drag during a curved line cut of deep and shallow engraving similar to other prior art.

Publication titled "A Practical Course in Jewelry Engraving" by Albert A. Winter published in 1939 discloses two sets of illustrations, one on page 45 titled "Correct Method of Graver Sharpening, Showing Graver Heeled at Various angles" and a second set of illustrations on page 46 titled "Incorrect Way, Showing Gravers Brought Back to Original Sharpening". In the first illustrations titled "Correct Method . . . etc . . . " the graver heels are disclosed as other prior art previously discussed, with the heels running a long distance on the bottom of the graver that like other prior art will drag when cutting curved lines and while turning tight corners. In the second set of illustrations titled "Incorrect way . . . etc . . . ", drawings of the bottom of gravers are shown with what the heel would look like when the face angle of the graver is changed. The author of the publication preferred the graver face angle at approximately 45 degrees. The drawings show what the heel would look like from the bottom of the graver when at a greater or less than 45 degree face with lines to represent what the heel would look like from the bottom when the face angle is brought back to 45 degrees. The drawings are therefore illustrating more than one graver in one illustration by showing what would be removed or added when a graver's face is brought back to the author's desired 45 degree face angle. Two side view drawings on the right of this illustration page help to show what the author is describing concerning his desired 45 degree face angle.

In the art of hand engraving, jewelry engraving and stone setting, a tool tip is needed that will provide the benefit of a heel running the length of the cutting edge V for deep engraving but without having a long trailing heel that will drag during shallow engraving or deeper engraving when used in a curved line or turning a sharp corner while executing an engraving cut.

OBJECTS AND SUMMARY OF THE INVENTION

In recent times a pneumatic power hand graver the size of the traditional palm push graver has been disclosed in U.S. Pat. No. 6,095,256, to Lindsay. Before the development of the pneumatic powered palm push sized graver, those skilled in the art were continuing to utilize the traditional manual palm push method for very delicate banknote style of hand engraving. With the manual palm push method, the depth of cut was limited to only what could be pushed by the hand. The cutter tip heels therefore did not need to run all the way up the V cutting edges of the cutter tip for deep engraving since the manual method cutter tip was for generally shallow depth engraving. With the pneumatic powered palm push sized tools, users can have a great range of engraving depths and therefore a tool tip is needed that can be used for shallow as well as deep engraving cuts without the user having to modify the tool tip or change the tool tip to go from shallow engraving to deep engraving. It is the object of this invention to provide a burin engraving tool tip that will provide the benefit of a heel running all the way up the cutting edge V for deep engraving without possessing a triangle long heel that trails behind the cutting point that can be used for fine detailed engraving and preventing heel drag in a curved line or when the user turns a sharp corner while in a deep or shallow cut.

BRIEF DESCRIPTION OF THE DRAWINGS

Embodiments of the invention are described below with reference to attached drawing figures, wherein:

FIG. 25 through FIG. 30 are six views of a single point engraving cutter tip similar to the prior art illustrated in FIG. 13 through FIG. 18 but in accordance with the invention by having heel relieving facets that are illustrated ground slightly incorrectly leaving a non parallel cutting heel running up the sides of the V cutting edges;

DETAILED DESCRIPTION

There are nine drawing sheets (1 through 9). On each sheet there are six views of one embodiment of an engraving cutter tip.

Figure 1:
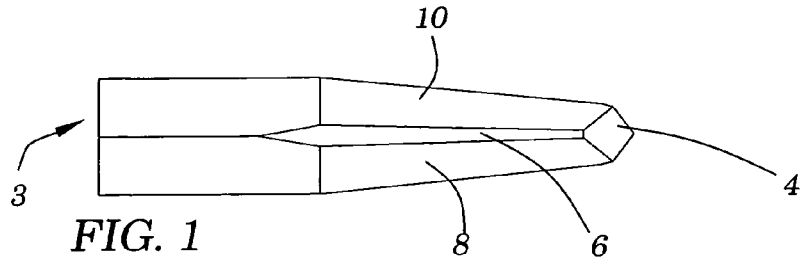
FIG. 1 Prior Art
FIG. 1 through FIG. 6 are six views of a PRIOR ART single point engraving cutter tip having a full length heel on its V cutting edge and the resulting long trailing heel.
Figure 2:
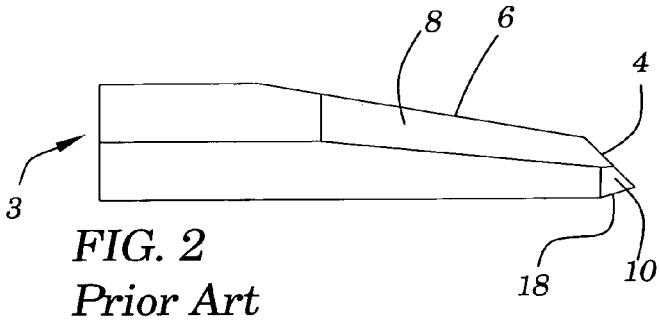
FIG. 2 Prior Art
Figure 4:
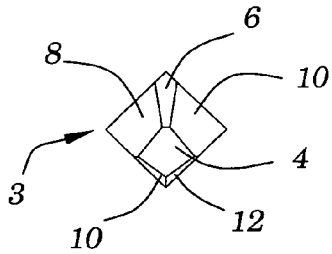
FIG. 4 Prior Art
Figure 3:
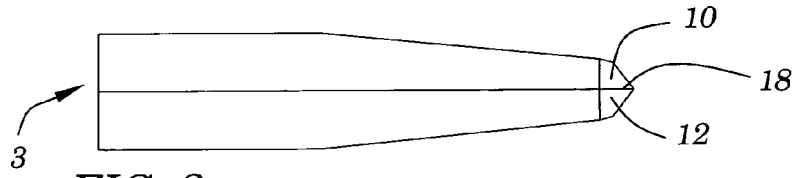
FIG. 3 Prior Art
Figure 5:
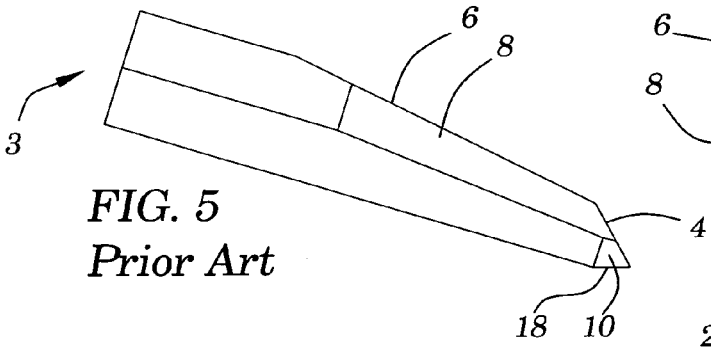
FIG. 5 Prior Art
Figure 6:
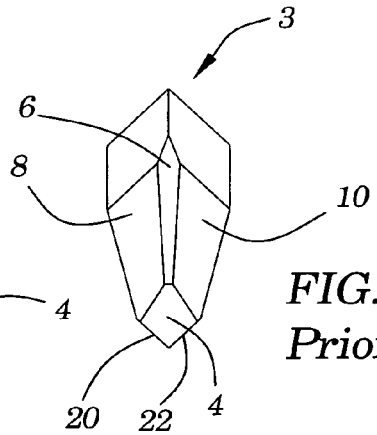
FIG. 6 Prior Art
Figure 7:
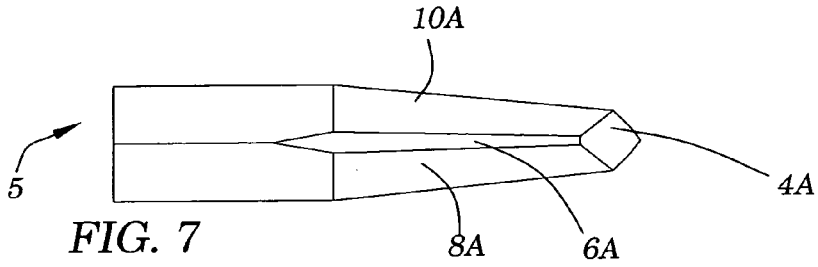
FIG. 7 Prior Art
FIG. 7 through FIG. 12 are six views of a second PRIOR ART single point engraving cutter tip having a short trailing heel resulting in very little heel on the V cutting edge.
Figure 8:
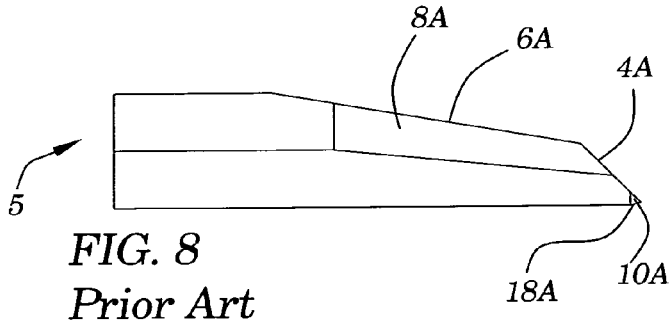
FIG. 8 Prior Art
Figure 10:
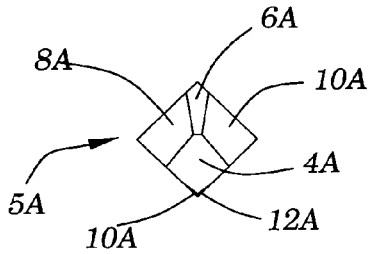
FIG. 10 Prior Art
Figure 9:
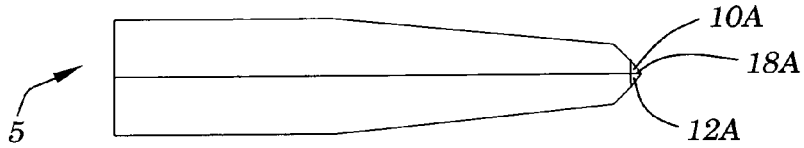
FIG. 9 Prior Art
Figure 11:
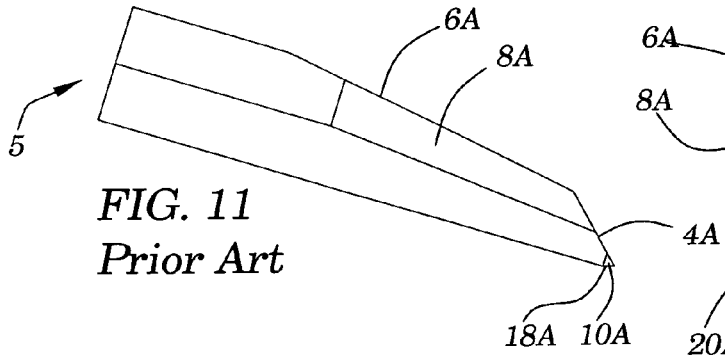
FIG. 11 Prior Art
Figure 12:
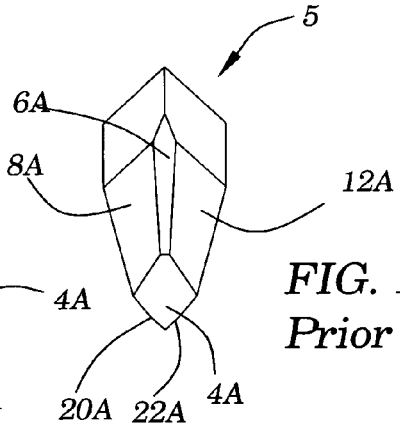
FIG. 12 Prior Art
Figure 13:
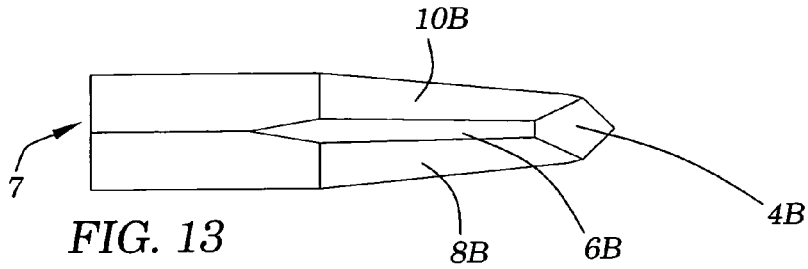
FIG. 13 Prior Art
FIG. 13 through FIG. 18 are six views of a third PRIOR ART single point engraving cutter tip similar to the one illustrated in FIG. 1 through FIG. 6 but with a sharper face angle resulting in an even longer trailing heel.
Figure 14:
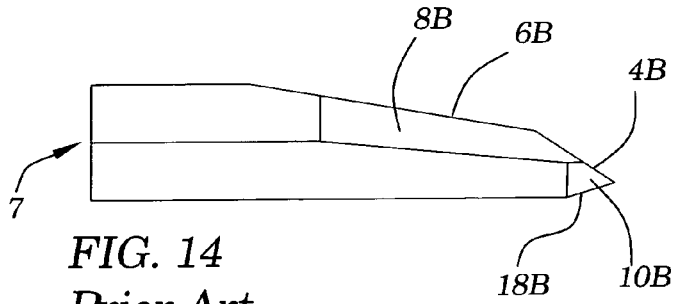
FIG. 14 Prior Art
Figure 16:
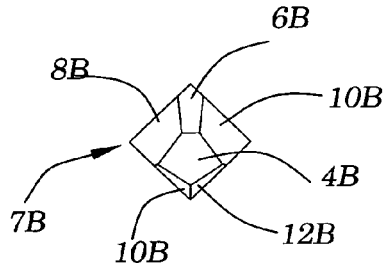
FIG. 16 Prior Art
Figure 15:
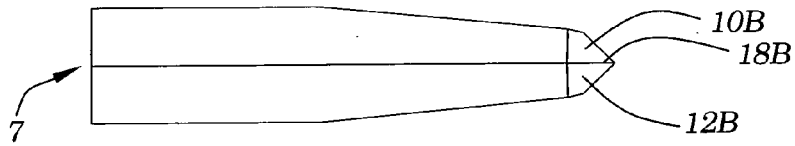
FIG. 15 Prior Art
Figure 17:
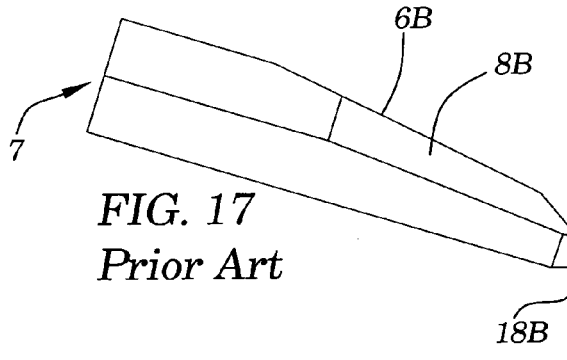
FIG. 17 Prior Art
Figure 18:
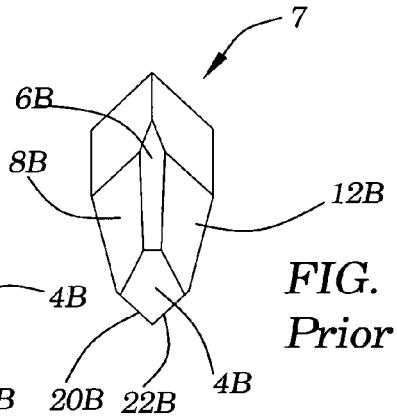
FIG. 18 Prior Art
Figure 19:
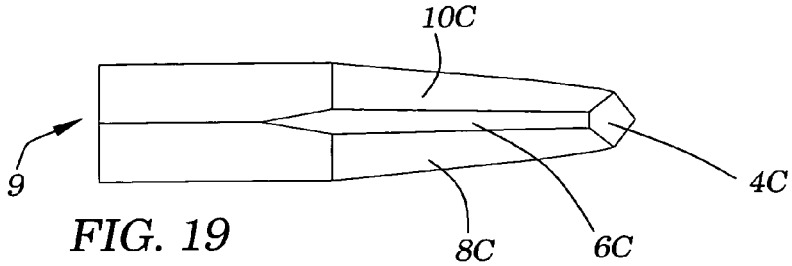
FIG. 19 through FIG. 24 are six views of a preferred embodiment of a single point engraving cutter tip similar to the prior art illustrated in FIG. 1 through FIG. 6 but in accordance with the invention having heel relieving facets for removing all but a small amount of the primary heel at the V cutting edges and a small trailing heel.
Figure 20:
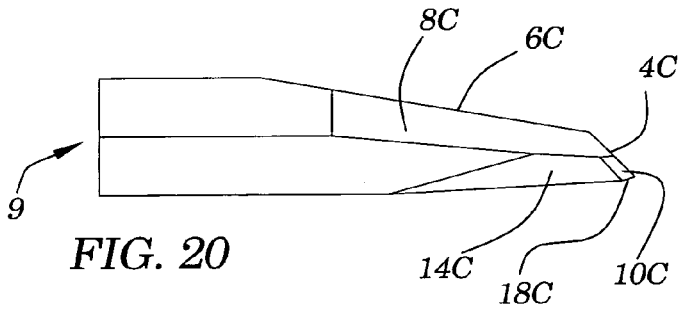
Figure 22:
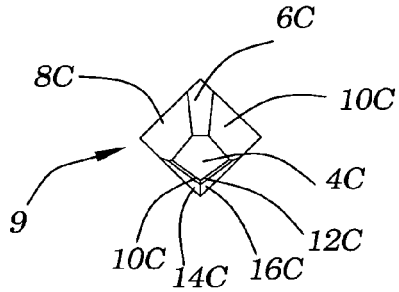
Figure 21:
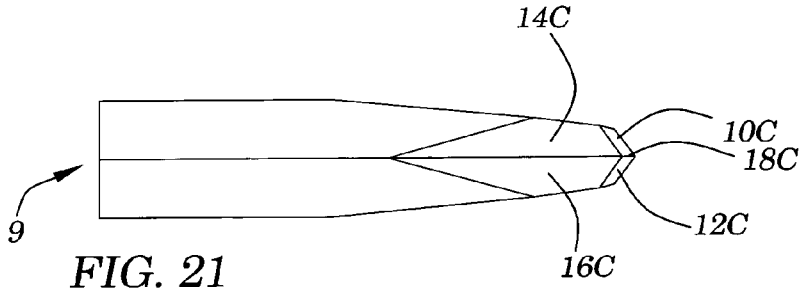
Figure 23:
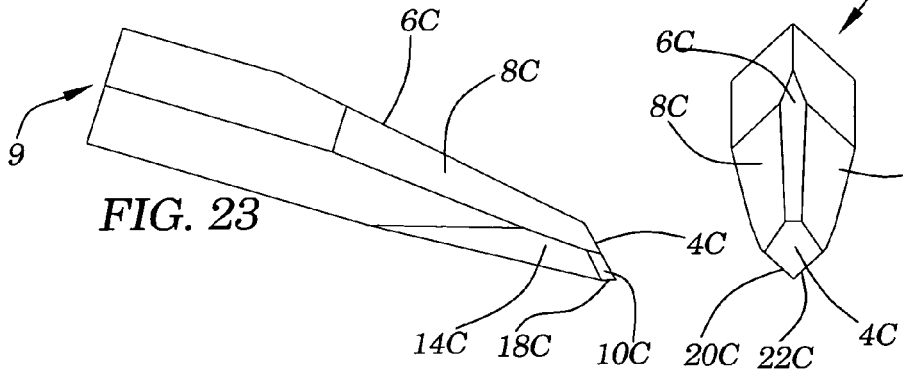
Figure 24:
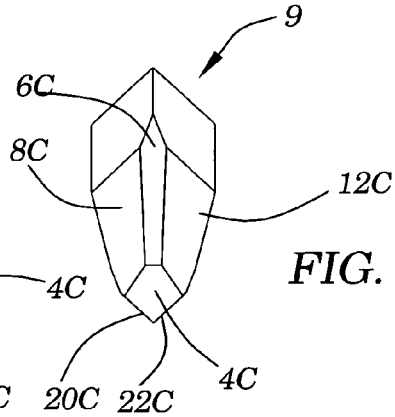
Figure 31:
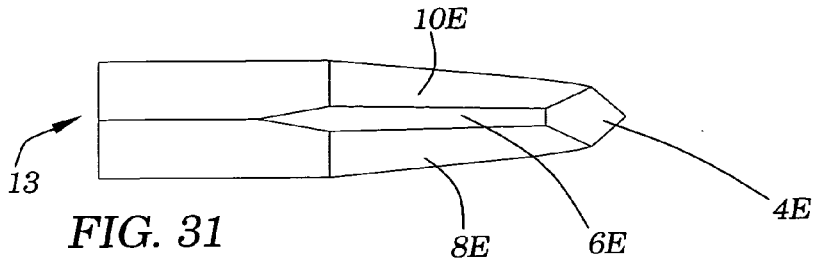
FIG. 31 through FIG. 36 are six views of a single point engraving cutter tip similar to FIG. 13 through FIG. 18 but with correctly ground heel relieving facets in accordance with the invention.
Figure 32:
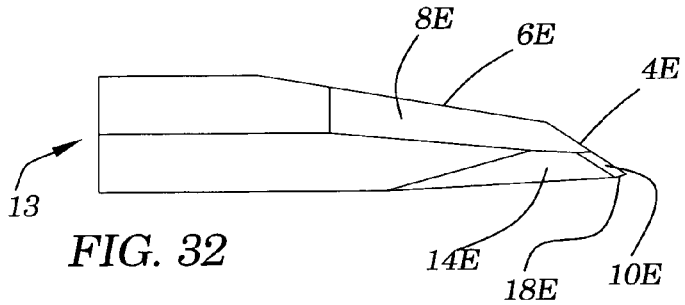
Figure 34:
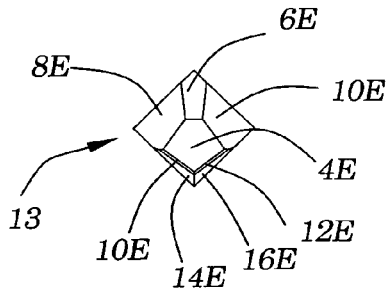
Figure 33:
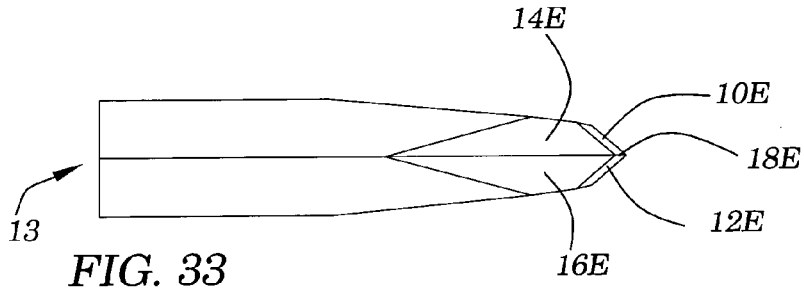
Figure 35:
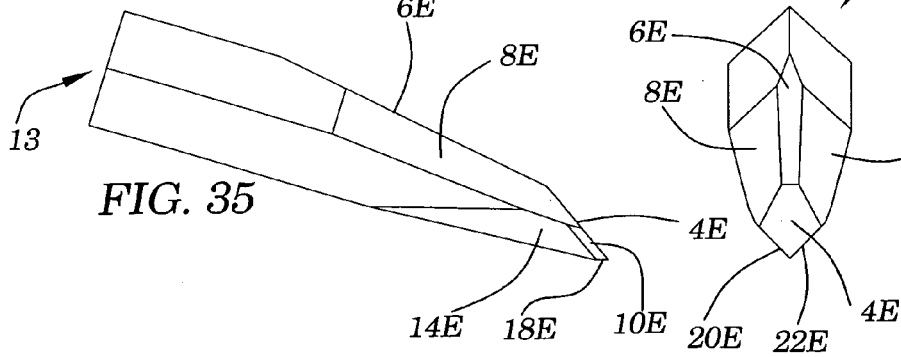
Figure 36:
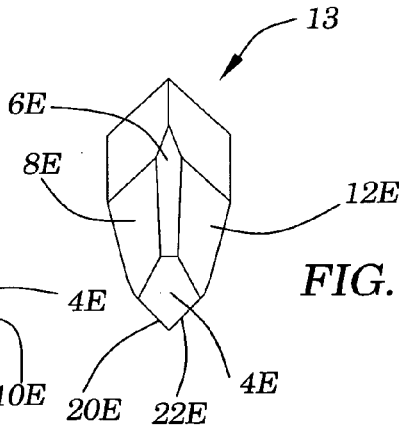
Figure 37:
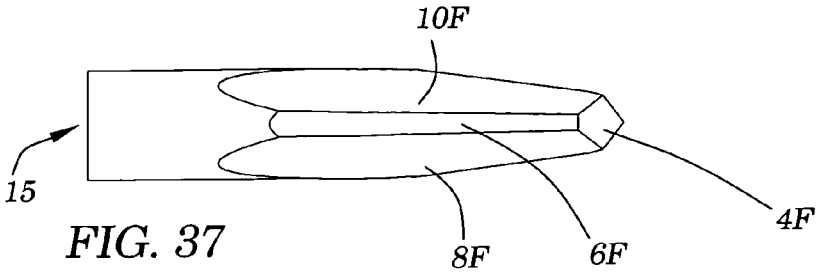
FIG. 37 through FIG. 42 are six views of a single point engraving cutter tip having the same tool tip illustrated in FIG. 19 through FIG. 24 but the shank stock material has a circular profile rather than square profile in accordance with the invention.
Figure 38:
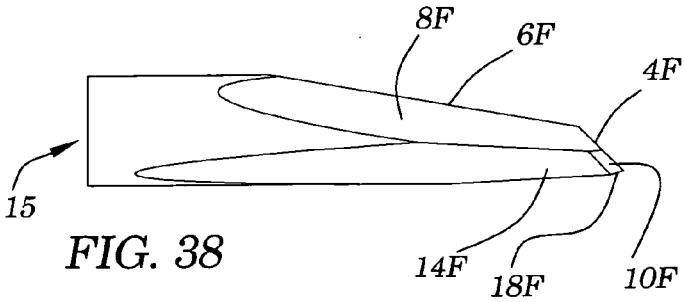
Figure 40:
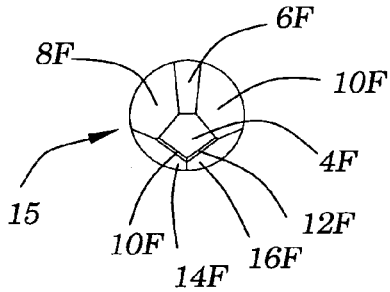
Figure 39:
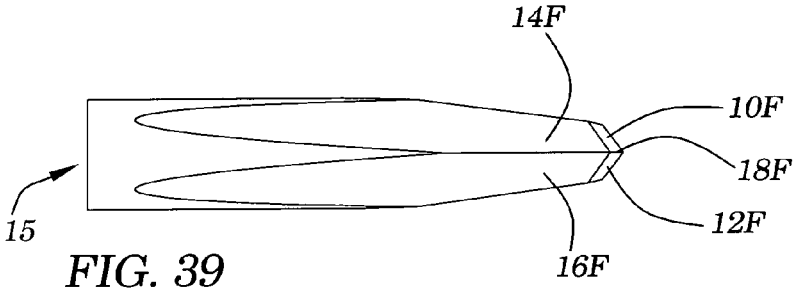
Figure 41:
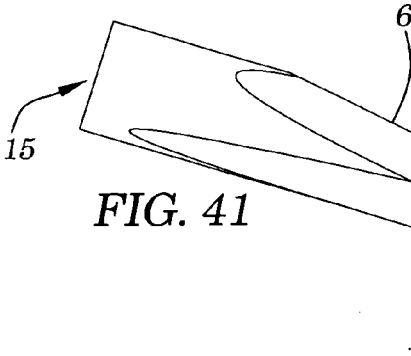
Figure 42:
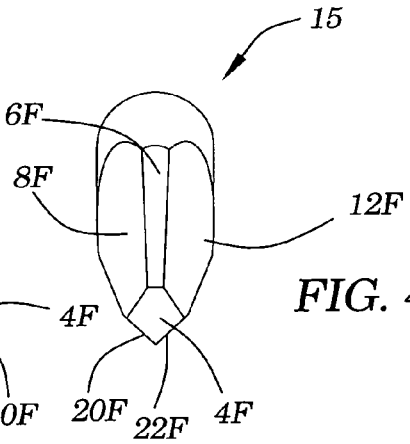
Figure 43:
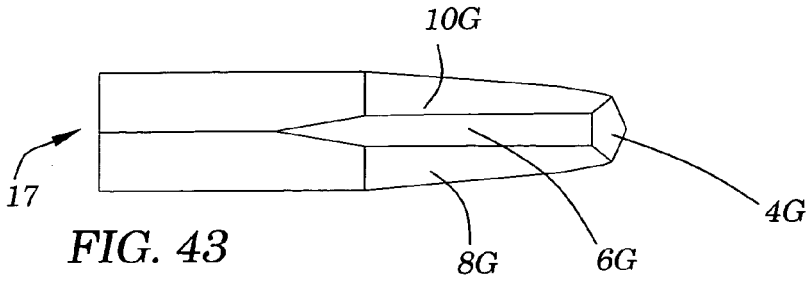
FIG. 43 through FIG. 48 are six views of a single point engraving cutter tip illustrating the heel relieving facets on a more opened up or wide V profile on a square stock shank in accordance with the invention.
Figure 44:
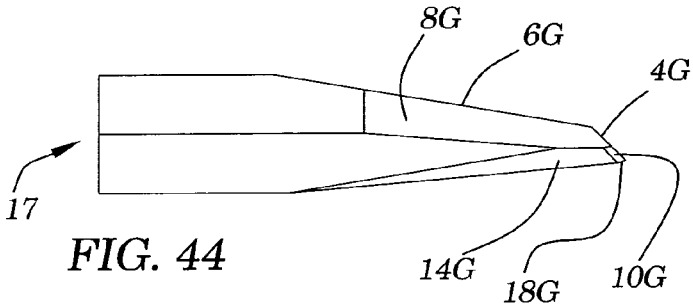
Figure 46:
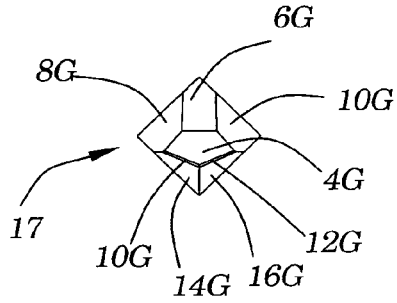
Figure 45:
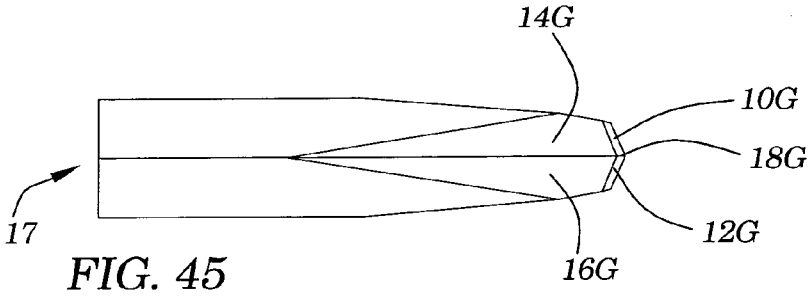
Figure 47:
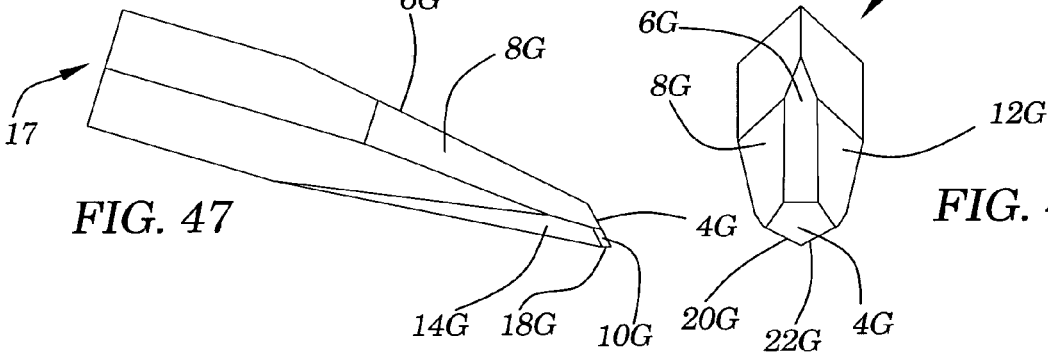
Figure 48:
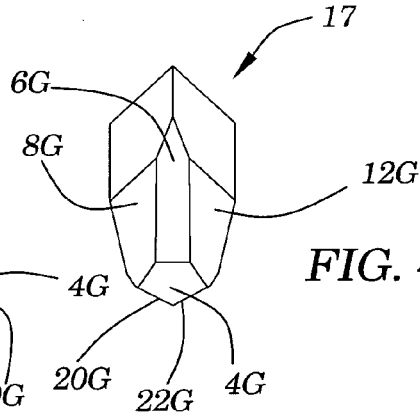
Figure 49:
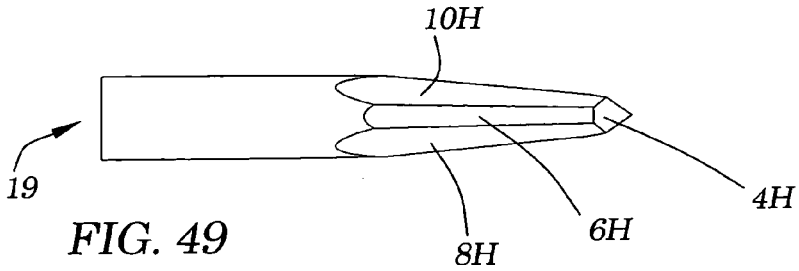
FIG. 49 through FIG. 54 are six views of a single point engraving cutter tip illustrating the heel relieving facets on a more narrow V profile on a round stock shank in accordance with the invention.
Figure 50:
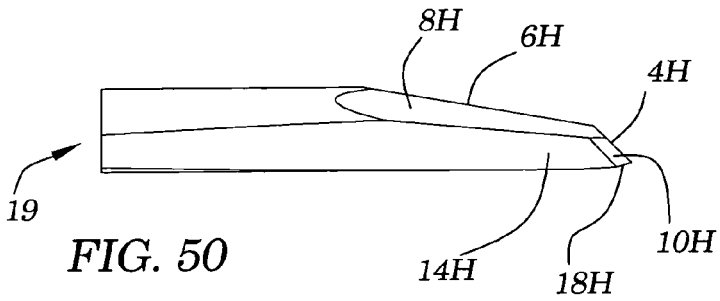
Figure 52:
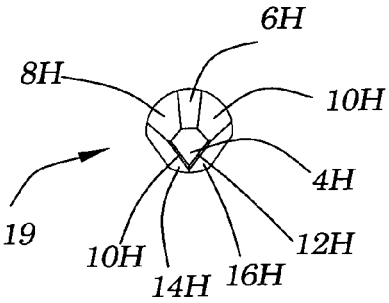
Figure 51:
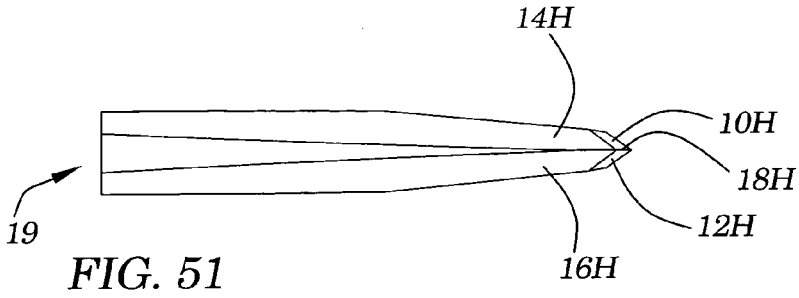
Figure 53:
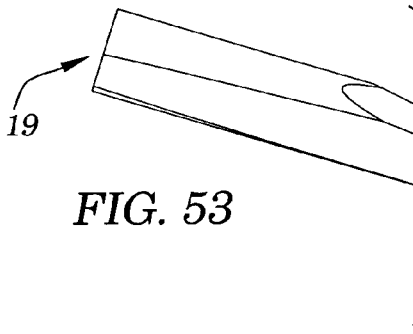
Figure 54:
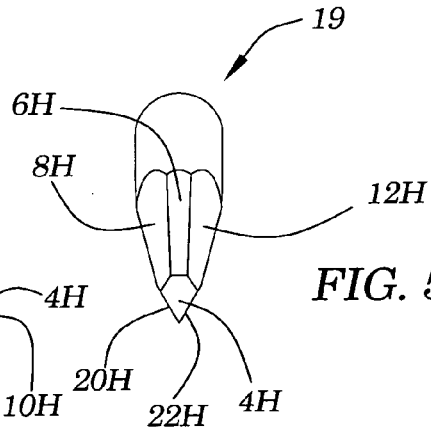

FIG. 1 through FIG. 6 are six views of a PRIOR ART single point engraving cutter tip 3 having a heel 18 that is created from heel facets 10 and 12. This PRIOR ART cutter tip heel design is the configuration used by engravers for deep engraving work. A heel is placed on an engraving tool tip to change the angle of attack that the tool cuts. A heel is therefore used to give clearance for the hand to push the tool through the work. FIG. 5 and FIG. 6 illustrate the angle of the tool tip as it would be used for engraving on a horizontal surface. The tool tip in FIG. 5 is illustrated tilted, so that heel 18 is horizontal. During use, the user will tilt the tool tip at a slightly greater angle of attack than this for diving into a cut and then level it out as shown in the FIG. 5 illustration so that the heel is horizontal in order to maintain the cut at a certain depth. When desired, the angle of attack is decreased by the user and the cutter will begin coming out of the cut. FIG. 6 is a front view of the cutter as it travels through a cut. The profile of V cutting edges 20 and 22 is the V shape of the furrow that will result in the material being engraved. Heel facets 10 and 12 are what make up and determine the angle of the V cutting edges 20 and 22. In order for a tool tip to make a deep cut, heel facets 10 and 12 need to travel at least as far up the V cutting edges 20 and 22 as the depth of cut desired. The cutter tip 3 is therefore in the configuration used by engravers for deep engraving work because heel facets 10 and 12 travel the full distance up the V cutting edges 20 and 22. The disadvantage of such large facets 10 and 12 is that it makes a heel 18 that is very long. A long heel trails behind the cutting point and is not a problem if the user engraves in a straight line, but when engraving a curved line or turning a corner while in a cut, this long trailing heel drags on the back side of the furrow cut. In other words, it is like trying to place a straight line segment (heel 18 in this case) into a furrow that is curved. The straight line segment does not fit and results in the back end of the segment dragging on one side of the curved furrow.

Referring to FIG. 1 through FIG. 6 on drawing page 1, additional features are true for all the embodiments in drawing pages 2 through 9. Face 4 on the front of the cutting tip can be angled more steeply, or less steeply creating a blunter or sharper point. Generally, engraving in harder material such as tool steels or harder stainless will require a blunter face angle while softer materials such as silver, copper or some softer gold require a sharper face angle. Three facets 6, 8, and 10 are illustrated on top of the cutter tip but are not necessary. These three facets are personal preference and the applicant uses these to create a slightly smaller face 4 than it would be without facets 6, 8, and 10.

A second PRIOR ART single point engraving cutter tip 5 is illustrated in FIG. 7 through FIG. 12. This embodiment is the same as the PRIOR ART embodiment illustrated in FIG. 1 through FIG. 6, although the size of the heel facets 10A and 12A are smaller. In order for fine line, shallow engraving to be achieved without the heel drag problem described in the embodiment in FIG. 1 through FIG. 6, those skilled in the art place heel facets 10A and 12A small so that the resulting heel 18A is short. This tool tip works very well for the fine line engraving work, and is capable of turning sharp radiuses and corners while in a cut without the heel dragging in fine cuts. This cutter tip will not, however, work for engraving deep cuts. If it is attempted to use this tool for a deep cut, the tool would dive quickly in a manner similar to a tool tip without any heel facets 10A and 12A at all.

A third PRIOR ART single point engraving cutter tip 7 is illustrated in FIG. 13 through FIG. 18. This embodiment is the same as the PRIOR ART embodiment illustrated in FIG. 1 through FIG. 6 although the angle of the face 4B is steeper, creating a more sharp elongated point. A user may desire a point similar to this when engraving in softer material, although as can be seen, this further increases the length of heel 18B compared to the embodiment illustrated in FIG. 1 through FIG. 6. This increased length heel 18B will make the heel drag problem worse.

The preferred embodiment in accordance with the invention illustrated in FIG. 19 through FIG. 24 shows six views of a single point engraving cutter tip 9 similar to the prior art illustrated in FIG. 1 through FIG. 6 but in accordance with the invention, the embodiment has two additional facets on the underside. These two additional facets are called relieving facets 14C and 16C, and are placed in such a manner that they will remove all but a small amount of heel facets 10C and 12C so that all that is left of heel facets 10C and 12C is an area substantially parallel with the V cutting edges 20C and 22C. With relieving facets 14C and 16C this embodiment provides a cutter tip with the benefit of a heel running all the way up V cutting edges 20C and 22C for deep engraving but without possessing a long heel 18C. This embodiment therefore can be used for fine detailed engraving without the heel drag problem in a curved line or when the user turns a sharp corner while in a cut and it may also be used for deep engraving without it diving since the heel runs the length of V cutting edges 20C and 22C.

The second embodiment in accordance with the invention in FIG. 25 through FIG. 30 illustrates a single point engraving cutter tip 11 having relieving facets 14D and 16D that are illustrated ground slightly incorrectly leaving a non parallel cutting heel next to V cutting edges 20D and 22D. This embodiment still has an advantage over an embodiment without relieving facets 14D and 16D but it will not be capable of engraving as deeply as an embodiment with relieving facets 14D and 16D placed correctly and in such a manner that heel facets 10D and 12D run substantially parallel with V cutting edges 20D and 22D.

The third embodiment in accordance with the invention in FIG. 31 through FIG. 36 show a single point engraving cutter tip 13 which is similar to the embodiment in FIG. 25 through FIG. 30 although relieving facets 14E and 16E are more properly placed leaving heel facets 10E and 12E running substantially parallel with V cutting edges 20E and 22E.

The fourth embodiment in accordance with the invention in FIG. 37 through FIG. 42 show six views of a single point engraving cutter tip 15 having the same tool tip illustrated in FIG. 19 through FIG. 24 but the shank stock material has a circular profile rather than square profile. In accordance with the invention any shape tool stock or blank may be used to place the engraving cutter tip on. The round shank profile of cutter tip 15 is viewable in FIG. 40.

Cutter tip 17 is a fifth embodiment illustrated in FIG. 43 through FIG. 48 and illustrates how relieving facets 14G and 16G can be used with a wider profile V cutting edges 20G and 22G in accordance with the invention. The wider V profile is made and governed by the angle and placement of heel facets 10G and 12G. Cutter tip 17 is made on a square stock shank but the stock material shape can be any shape.

Cutter tip 19 is a sixth embodiment illustrated in FIG. 49 through FIG. 54 and illustrates how relieving facets 14H and 16H can be used with a narrow profile V cutting edges 20H and 22H in accordance with the invention. The narrower V profile is made and governed by the angle and placement of heel facets 10H and 12H. Cutter tip 19 is made on a round stock shank but the stock material shape can be in any shape.

CONCLUSION, RAMIFICATIONS, AND SCOPE

Accordingly, the reader will see that the invention provides an improved engraving cutter tip that will provide the benefit of a heel running all the way up the cutting edge V for deep engraving but without possessing a long heel that trails behind. Users of the cutter tip can easily go from fine engraving to deep engraver using the same cutter and without the disadvantage of a long trailing heel that can drag in a curved line or when the user turns a relatively sharp corner while in a cut.

Although the invention has been described with reference to the illustrated embodiments, it is noted that equivalents may be employed and substitutions made herein without departing from the scope of the invention as recited in the claims. For example:

The embodiments in the illustrations show round and square shank tool blanks used with the present invention but an equivalent may be made by using any shaped shank;

Only two relieving facets 14 and 16 have been illustrated but more than two can be employed without departing from the scope of the invention;

Only two heel facets 10 and 12 have been illustrated but more than two can be employed without departing from the scope of the invention; and The embodiments in the illustrations are shown with a relativity short shank. The shank of the embodiments can be of any length without departing from the scope of the invention.

Accordingly, the scope of the invention should be determined not by the embodiment illustrated, but by the appended claims and their legal equivalents.

I claim:

1. A method of engraving an object by hand comprising:

Providing a cutter point having a linear shank having a top side, a bottom side, and a front cutting end;

said front cutting end having the shape of a 'V' as viewed from said front cutting end;

at least two primary heel facets adjacent with said front cutting end and said bottom side;

at least two secondary relief facets on said bottom side and running a distance along said bottom side for relieving said at least two primary heel facets in such a way that the only portion of said primary heel facets remaining is a narrow portion, adjacent to and substantially parallel to said front cutting end;

attaching said linear shank to a handle;

placing said handle in a human hand;

setting said front cutting end on the surface of the object that is to be engraved; and forcing said front cutting end through the surface of the object, with a result of said cutter point cutting a 'V' furrow on the surface of the object.

2. A method of engraving an object by hand as recited in claim 1 wherein said linear shank having a square profile.

3. A method of engraving an object by hand as recited in claim 1 further comprising:

additional facets on said top side and in contact with said front cutting end.

4. A method of engraving an object by hand as recited in claim 1 further comprising:

additional facets on said top side and in contact with said front cutting end for reducing the size of said front cutting end; and said linear shank having a square profile.

5. A method of engraving an object by hand comprising:

Providing a cutter point having a linear shank having a top side, a bottom side, and a front cutting end;

said front cutting end having the shape of a 'V';

at least two primary heel facets in contact with said front cutting end and said bottom side;

said at least two primary heel facets determining width angle of said 'V';

at least two secondary relief facets on said bottom side and running a distance on said bottom side for relieving said at least two primary heel facets in such a way that the only portion of said primary heel facets that remains is a substantially narrow and parallel portion adjacent to said front cutting end;

attaching said linear shank to a handle;

placing said handle in a human hand;

setting said front cutting end on the surface of the object that is to be engraved; and forcing said front cutting end through the surface of the object, with a result of said cutter point cutting a 'V' furrow on the surface of the object.

6. A method of engraving an object by hand as recited in claim 5 wherein said linear shank has a square profile.

7. A method of engraving an object by hand as recited in claim 5 further comprising:

additional facets on said top side and in contact with said front cutting end.

8. A method of engraving an object by hand as recited in claim 5 further comprising:

additional facets on said top side and in contact with said front cutting end; and said linear shank having a square profile.

9. A method of engraving an object by hand comprising:

Providing a cutter point having a linear body having a top, a bottom, and a front cutting end;

said front cutting end having the profile shape of a 'V';

at least two primary heel facets in contact with said front cutting end and said bottom;

said at least two primary heel facets determining width angle of said 'V';

at least two secondary relief facets on said bottom and running a distance on said bottom for relieving said at least two primary heel facets in such a way that the only portion of said primary heel facets that remains is a substantially parallel portion in contact with said front cutting end;

attaching said linear body to a handle;

placing said handle in a human hand;

setting said cutter point on the surface of the object that is to be engraved; and pushing said cutter point along the surface of the object, with a result of said cutter point cutting a 'V' furrow on the surface of the object.

10. A method of engraving an object by hand as recited in claim 9 wherein said linear body has a square profile.

11. A method of engraving an object by hand as recited in claim 10 further comprising:

additional facets on said top and in contact with said front cutting end for reducing the size of said front cutting end.

12. A method of engraving an object by hand as recited in claim 10 further comprising:

additional facets on said top and in contact with said front cutting end for reducing the size of said front cutting end; and said linear body having a square profile.

* * * * *